US006085997A

United States Patent [19]

Mills et al.

[11] Patent Number: 6,085,997

[45] Date of Patent: Jul. 11, 2000

[54] REFILLABLE ATOMIZING SPRAY CAN

[75] Inventors: Gregory B. Mills, Seneca, Mo.; George Pelling, Huntington Beach, Calif.

[73] Assignee: Spraytex, Inc., Calabasas, Calif.

[21] Appl. No.: 09/300,655

[22] Filed: Apr. 27, 1999

[51] Int. Cl.[7] ..... F23D 14/34

[52] U.S. Cl. ..... 239/337; 239/366; 222/399

[58] Field of Search ..... 239/337, 365–369, 239/346, 348, 373; 222/399

[56] References Cited

U.S. PATENT DOCUMENTS

| | | | |
|---|---|---|---|
| 2,003,087 | 5/1935 | Lynger | 239/367 |
| 2,611,650 | 9/1952 | Palm | 239/346 |
| 2,665,943 | 1/1954 | Palm | 239/366 |
| 4,154,271 | 5/1979 | Saeki | 239/337 |
| 4,174,811 | 11/1979 | Binder et al. | 239/399 |
| 4,948,054 | 8/1990 | Mills | 239/325 |

*Primary Examiner*—Andres Kashnikow
*Assistant Examiner*—Dinh Q. Nguyen
*Attorney, Agent, or Firm*—Pillsbury Madison & Sutro LLP

[57] ABSTRACT

An inexpensive pneumatically-operated apparatus is disclosed for spraying a broad range of viscous materials that atomizes the sprayable material without using propellant gases, and can be filled with bulk texture or other fluid coatings. A container removably locks onto the bottom of a sealing disk, consisting of a dip tube, an elbow, an air jet member, an equalization port, and an equalization tube. A cap is selectively united with the sealing disk and the container. The user fills the container with the sprayable material, attaches it to the sealing disk and cap, and connects to an external air supply device. A spray nozzle is used to adjust the type of spray, and the user holds up the apparatus as one would hold an aerosol spray can. If the user covers the control orifice, trapping the air inside, air pressure builds inside the container and the apparatus atomizes and sprays the sprayable material until the supply is consumed or until the user removes the covering over the control orifice to stop spraying.

23 Claims, 4 Drawing Sheets

REFILLABLE ATOMIZING SPRAY CAN

FIELD OF THE INVENTION

This invention relates to an inexpensive pneumatically-operated apparatus that does the work of an aerosol spray can, but without the use of pressurized propellant gases that would be released into the atmosphere, robustly sprays a broader range of fluid viscosities, and can be refilled with bulk fluid coatings or liquid texture materials.

BACKGROUND OF THE INVENTION

Disposable aerosol spray cans have become very popular due to the convenience of being able to spray a wide array of fluid materials upon a surface. Billions of aerosol cans are consumed and discarded each year worldwide. However, there is a large price we pay ecologically for this convenience.

Graffiti, for example, is commonly done with aerosol cans, to the extent they are banned or controlled in some jurisdictions.

Aerosol cans release propellant gases into the atmosphere that are believed to add to the "greenhouse effect". And, non-fluorocarbon propellants, which are better than CFC's ecologically, are generally flammable and may injure people who breath the discharged gas in a closed area or get burned in a flash fire. Flammable conditions always exist when propane is used as the propellant. Some governmental agencies have limited the types and amounts of propellant gases that may be used in disposable aerosol spray cans.

Another problem is that current aerosol spray cans are disposable after only one use and are not refillable, creating tons of non-recyclable waste. If aerosol cans were recyclable or refillable, the waste factor would be reduced.

There are also problems of safe and user friendly discharge of some fluids using aerosol cans. For example, standard aerosol cans discharge abruptly when used with fluids containing particulate matter in suspension, for example. The maximum safe inflated pressure of the can is required to discharge heavy viscous fluids. Some fluid materials will not spray out of aerosols at all.

The Venturi spray effect that current disposable aerosol cans use is limited to liquids with a thin-enough viscosity to sustain this effect. However, atomization allows a broader range of viscous fluids and other liquid materials to be sprayed. Compressed air is injected just behind a spray orifice along with the fluid to achieve the atomization effect. Atomization is a preferred method of controlling the characteristics of the discharged spray.

Furthermore, some "settling" problems are not easily overcome by shaking aerosol cans with marbles or steel balls enclosed for that purpose. If the user had a way to open the can, complete mixing could be accomplished and confirmed.

It would be advantageous if there was an inexpensive substitution for the disposable aerosol spray can that is user refillable, that does not release propellant gases into the atmosphere, would spray a broader range of fluids, is not useful for graffiti vandals, is user-friendly with heavy viscous fluids, uses the atomization spray effect, and would allow the user to fully mix the contained materials.

U.S. Pat. No. 3,062,453 to Stem et al. (the '453 patent) discloses a traditional aerosol spray can utilizing an aerosol-pressurized texture material to spray the texture onto a wall or the like. The device described in the '453 patent has the disadvantages of the prior references, particularly in that it is not user refillable, and that it uses propellant gases to spray the texture material.

U.S. Pat. No. 4,948,054 (the '054 patent) issued to the present Applicant discloses an apparatus for spraying a texture material onto a wall or ceiling. Positive air pressure is created by closing an air escape opening on the apparatus with a finger, forcing the texture material downwards the apparatus and towards the exit orifice at the bottom of the apparatus. However, the apparatus disclosed in the '054 patent cannot be held upright in a spray can-like fashion, because the texture material is held in a large container positioned above the exit orifice, requiring the user to "hug" the apparatus with both arms during operation, thus not offering the ease of use and the portability found in traditional aerosol spray cans.

SUMMARY OF THE INVENTION

It is an object of the present invention to provide an improved refillable atomizing spray apparatus that obviates, for practical purposes, a number of the above-mentioned limitations.

In general terms, a portable sprayer, powered by a small air compressor or HVLP turbine, is disclosed that can spray a wider variety of fluid materials than traditional pressurized propellant aerosol spray cans.

The spray apparatus consists of a hollow body, having a closed bottom and an open top with sealing means. Other features and advantages of the invention will become apparent from the following detailed description, taken in conjunction with the accompanying drawings that illustrate, by way of example, various features and embodiments of the invention.

BRIEF DESCRIPTION OF THE DRAWINGS

A detailed description of the embodiments of the invention will be made with reference to the accompanying drawings, wherein like numerals designate corresponding parts in the several figures.

DETAILED DESCRIPTION OF THE PREFERRED EMBODIMENTS

Figure 1:
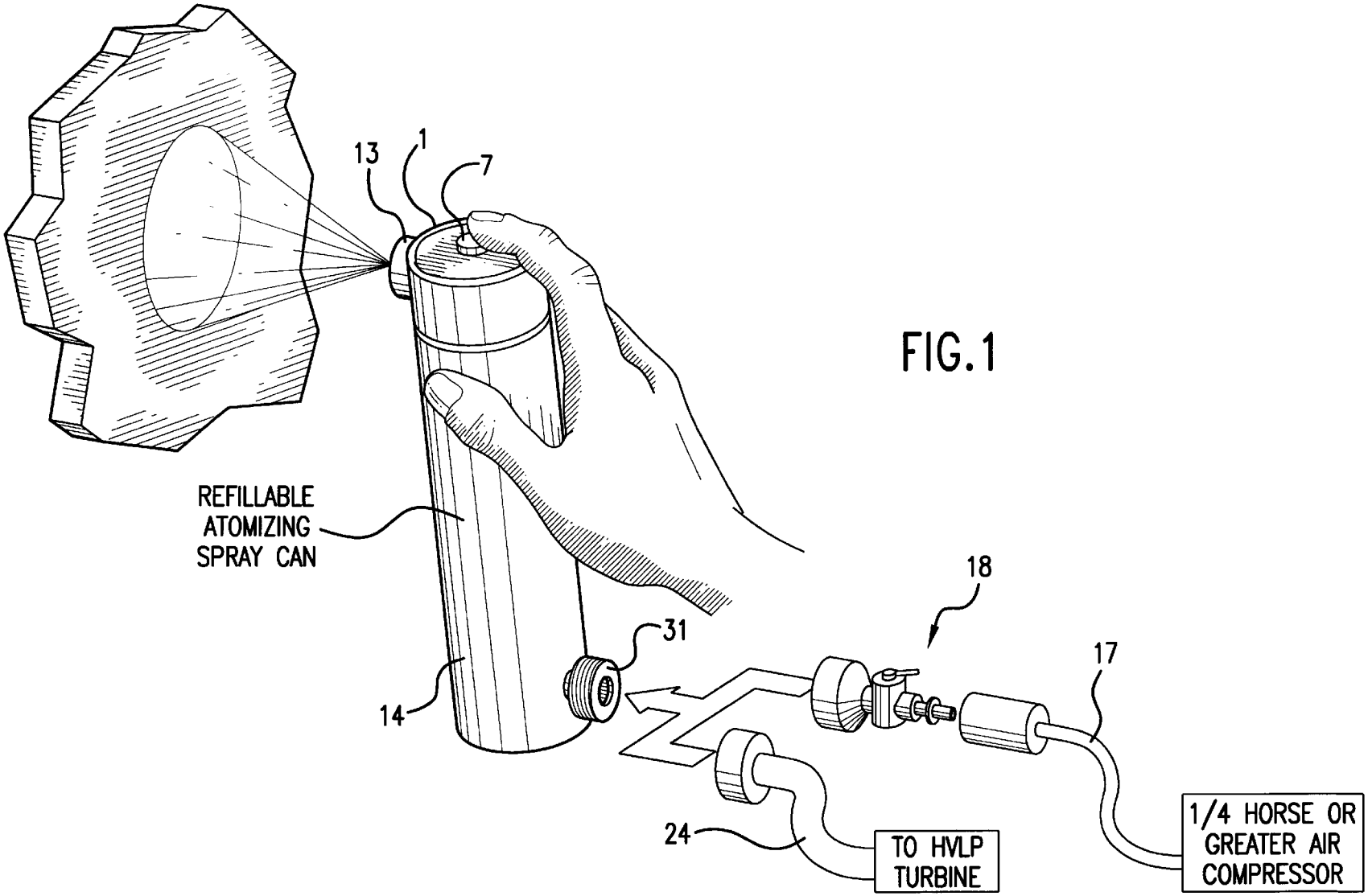
FIG. 1 is a perspective view of a refillable atomizing spray apparatus in accordance with an embodiment of the present invention.

As shown in the drawings for purposes of illustration, the invention is embodied in a refillable atomizing spray apparatus. In preferred embodiments of the present invention, the refillable atomizing spray apparatus is used to spray a fluid, like that of an aerosol spray can, without the use of pressurized propellant gases and can be refilled with bulk texture or other fluid coatings. However, it will be recognized that further embodiments of the present invention may be used to spray a broad range of materials, including those with high viscosities and those with particulate matter.

Figure 2:
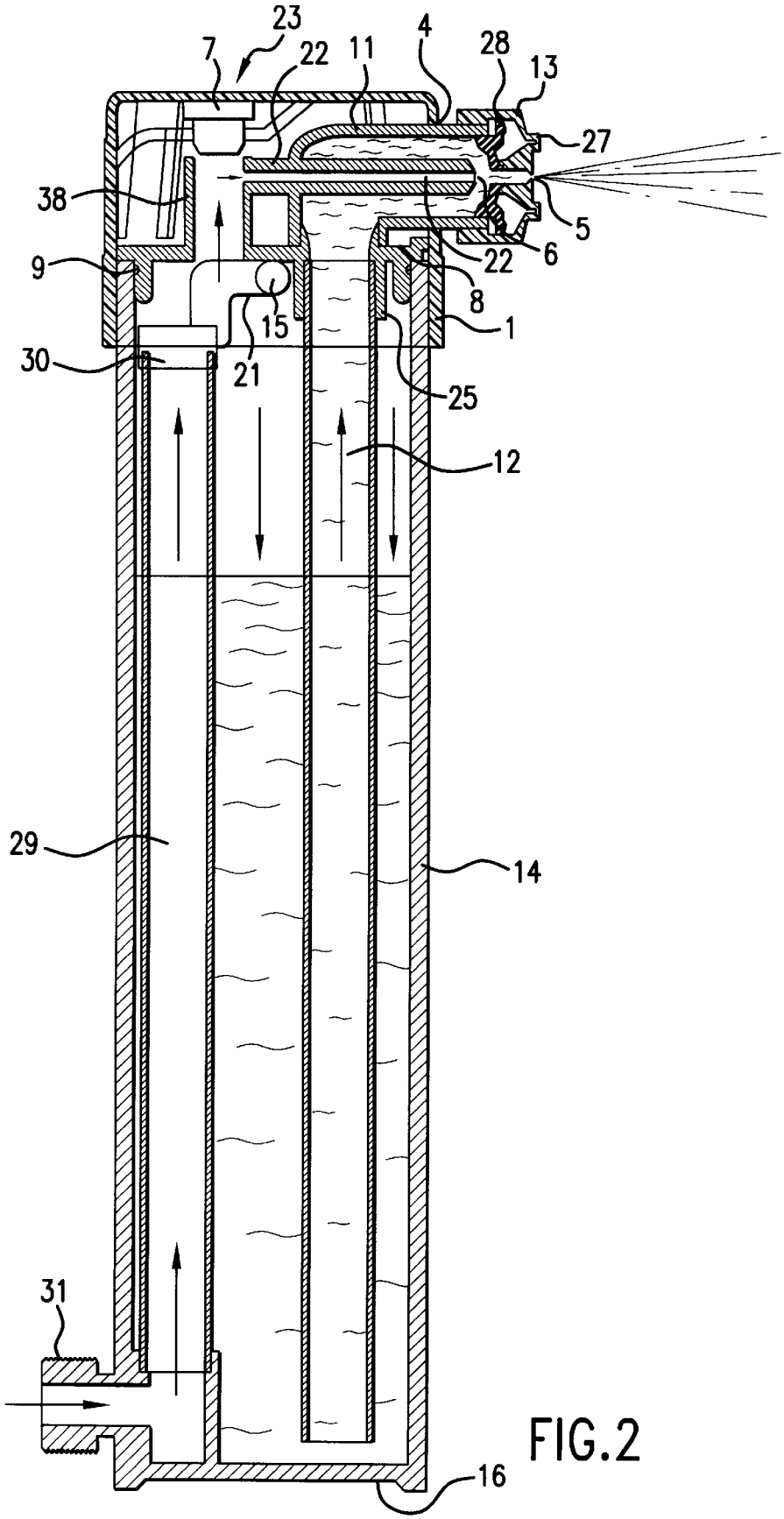
FIG. 2 is a cross-sectional view of the refillable atomizing spray apparatus in accordance with an embodiment of the present invention.

FIGS. 1 and 2 illustrate a perspective view and a cross-sectional view, respectively, of a refillable atomizing spray apparatus in accordance with an embodiment of the present invention. The refillable atomizing spray apparatus includes a container 14 having a closed bottom 16, which may be flat to facilitate placement upon a flat surface for filling the apparatus. The container 14 may be cylindrical or some other shape with a closed bottom 16 and an open top. The drawings show the invention in a cylindrical version. The container 14 is made of a material that is metal, plastic, or other substance that is rigid and will safely contain pressure. The container 14 may have an attachment member 15 on an upper section of the container 14 for attachment to a retaining member 21 on the cap 1. The container 14 may be assembled from parts or may be molded in one part. The outer surface of the container 14 may be decorated with a label and or instructions for apparatus use. The capacity of the container 14 may be variable according to intended use. A storage cap may be adapted to fit over the container 14 in place of the cap 1 for long term storage of the sprayable materials within the container 14.

Figure 3:
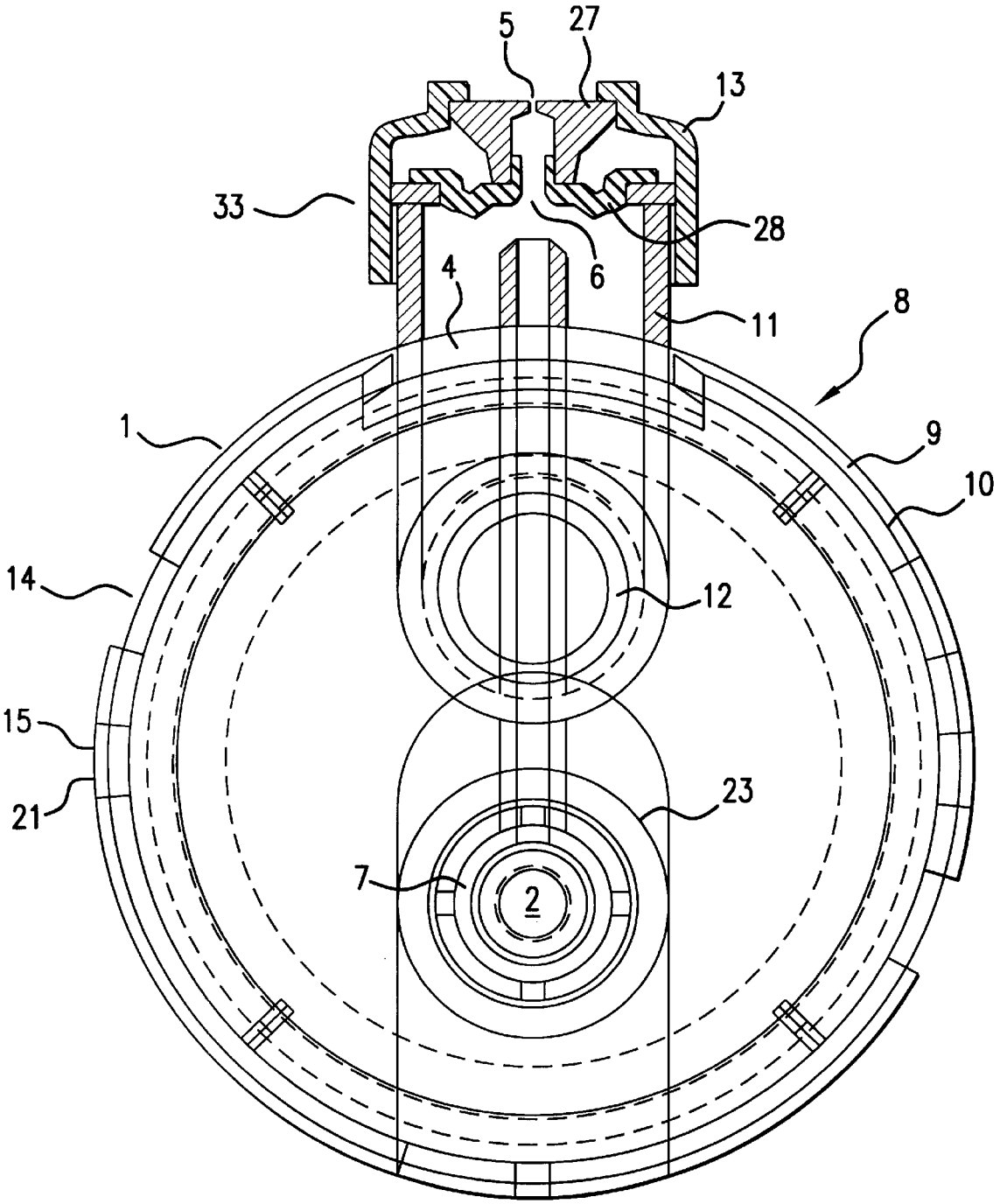
FIG. 3 is a top cross-sectional view of the refillable atomizing spray apparatus in accordance with an embodiment of the present invention.

In the embodiments illustrated in FIGS. 2 and 3, there is an air supply tube 29 located inside the container 14 with a top end and a bottom end, and a rubber flap cap 30 attached to the top end of the air supply tube 29 to prevent the material from being poured down the air supply tube 29. The air supply tube 29 interconnects with an external air supply device, such as a HVLP turbine or an air compressor, through the air inlet port 31 of the container 14.

The sealing disk 8, which is adapted to fit within the cap 1 and the open top of the container 14, is an assembly of all the remaining parts, which may include an elbow 11, an air jet member 22, and a gasket 9 and gasket slot 10. The cap 1 consists of a generally cylindrical part with a top chamber and a front opening 4. The cap is sized to snuggly fit over the sealing disk 8, to be described below. The top of the cap 1 has an orifice that is referred to as a button hole 23. The front opening 4 of the cap 1 is adapted to allow the spray opening 6 portion of the elbow 11 to fit through when the cap 1 and the container 14 are selectively united.

The sealing disk 8 is made of a material that will hold the anticipated pressure. The sealing disk 8 and elbow 11 may be of one or more parts and may be injection-molded of metal or plastic. The sealing disk 8 also consists of a dip tube 12 of sufficient diameter to allow the flow of the sprayable material from the main chamber of the container 14 to the spray orifice 5 of a spray nozzle 33 without undue restriction. The dip tube 12 attaches to a bottom of the sealing disk 8 at a dip tube attachment sleeve 25, which is an orifice on the sealing disk 8. The dip tube 12 may be separately manufactured and glued or pressed into the dip tube attachment sleeve 25. The dip tube 12 and the elbow 11 may also be of one part, so that the dip tube 12 is curved at the top and extending through the dip tube attachment sleeve 25 of the sealing disk 8.

On the sealing disk 8, there may be a gasket 9 that is made of a resilient rubber-like material that serves to pneumatically seal the completed apparatus. The gasket 9 seats in a gasket slot 10 at the bottom of the sealing disk 8. The gasket 9 fits between the sealing disk 8 and an upper interior surface of the container 14. The sealing disk 8 removably attaches to the container 14 and also supports the cap 1. The sealing disk 8 is of such a size as to allow the cap 1 to fit over the sealing disk 8 snuggly. The elbow 11 supports an air jet member 22, which is a cylindrical tube that interconnects an air space within the elbow 11 and an equalization tube 38. There may be a floating control button 7, made of a rubber-like material that snaps into the button hole 23 on the cap 1 in such a way that the floating control button 7 is free to rise on a current of air from a control orifice 2 of the equalization tube 38 when the device is pressurized but not in spray use. When the floating control button 7 is depressed, the flow of air is trapped within the equalization tube 38 and forced out the more restrictive air passage of the air jet member 22 and a spray opening 6 of the elbow 11.

Figure 4:
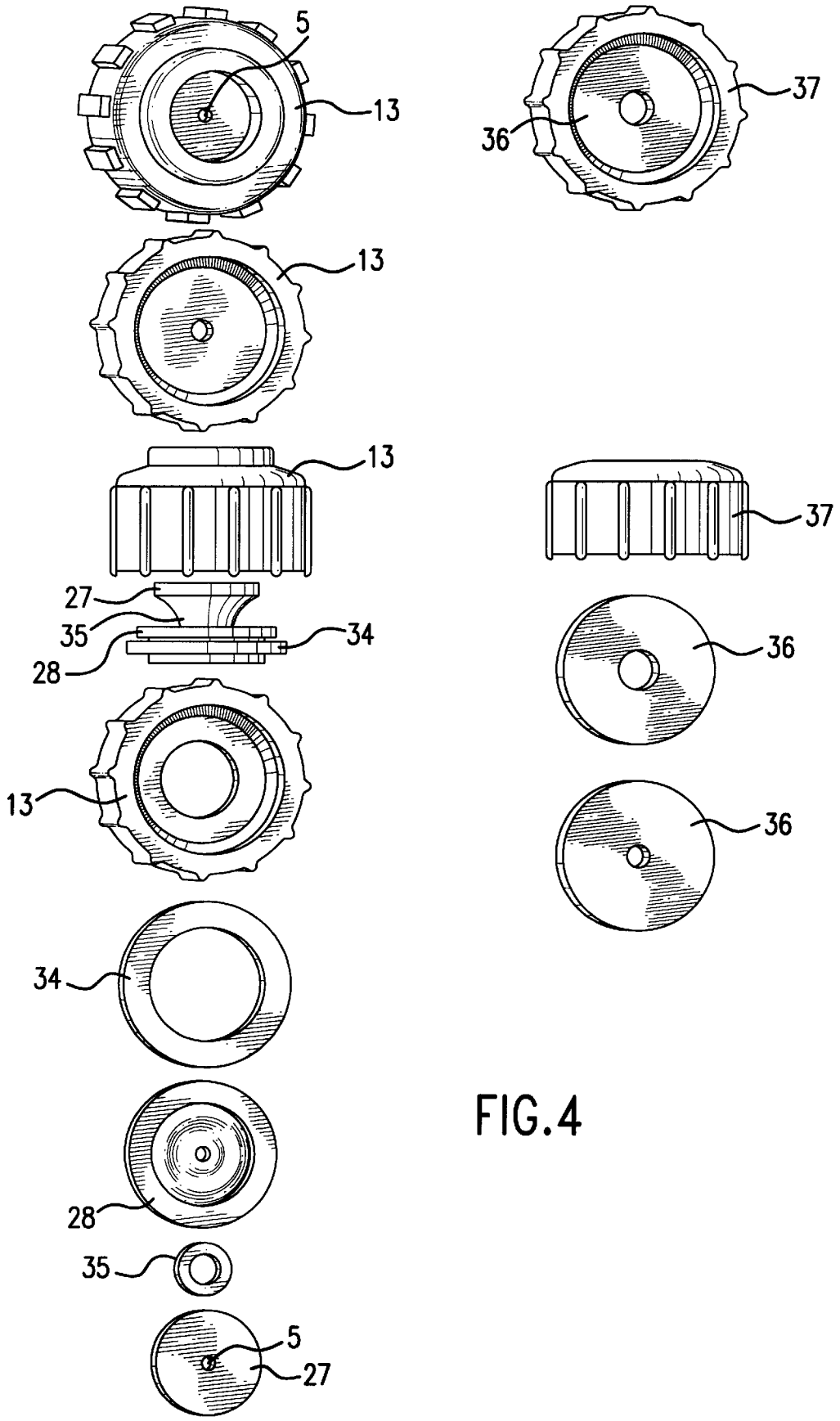
FIG. 4 illustrates various nozzle spray caps for the refillable atomizing spray apparatus in accordance with an embodiment of the present invention.

The spray opening 6 portion of the elbow 11 is threaded to allow various caps to be selectively attached to the apparatus based upon the specific material to be sprayed. As shown in FIG. 4, there are two main types of caps, which are designated as the adjustable spray cap 13, and the plastic cap for metal disks 37.

The adjustable spray cap 13 is based upon U.S. patent application Ser. No. 08/823,902, filed by John Woods and assigned to SprayTex Corporation, incorporated herein by reference. The spray nozzle 33 was designed for use with standard aerosol cans and was modified to form an assembly secured to the adjustable spray cap 13. When the adjustable nozzle cap 13 is tightened to the spray opening 6 of the elbow 11, it enlarges the spray orifice 5 to increase the spray; and when the adjustable spray cap 13 is loosened, the spray orifice 5 returns to a smaller diameter. The parts that make up the spray nozzle assembly 33 may include an adjustable spray cap 13, a large disk washer 34 that retains the parts, a nozzle disk 28, a small washer 35, and an adjustable rubber nozzle member 27 with a spray orifice 5. The spray nozzle assembly 33 allows the user to adjust the spray characteristics during spraying operations. The second type of cap, the plastic cap for metal disks 37, may hold metal spray disks 36 in the spray orifice 5 position. The purpose of the metal spray disks 36 is to allow abrasive materials to be sprayed without wearing out the rubber nozzle member 27.

When the apparatus is assembled, the cap 1 is placed over the sealing disk 8 and attached, preferably by the spray nozzle 33 by tightening the spray nozzle 33 to the spray opening 6 of the elbow 11 and engaging the cap 1 at the front opening 4 of the cap 1. The cap 1 and sealing disk 8 are removably attached to the container 14 to fully assemble the apparatus. The cap 1 may also have a retaining member 21 that retains the cap to an attachment member 15 of the container 14. The user removes the container 14 and fills the container 14 with the sprayable material. The container 14 is then removably attached to the sealing disk 8 and the cap 1.

As illustrated in FIG. 1, there may be an air compressor with a flexible external air hose 17 interconnected with an air compressor adapter 18 on its distal end to the air inlet port 31. The flexible external air hose 17 may be of any appropriate length and of any appropriate material. There may be a HVLP turbine with a HVLP hose that may be connected to the air inlet port 31 of the container 14 to supply air flow.

Air supplied within the apparatus normally leaks out of the control orifice 2 into the atmosphere as fast as it is introduced into the apparatus. The user picks up the apparatus and places a fingertip over the control orifice 2 or the floating rubber control button 7 seated within the button hole 23 on the cap 1 to momentarily seal the control orifice 2 to pressurize the apparatus and create an air pocket with a pressure greater than the surrounding atmosphere. The compressed air pocket places pressure upon the surface of the sprayable material and forces it downward to exit up the dip tube 12 and out through the spray opening 6. At the same time, there is increased air pressure within the equalization tube 38 and air flows out the air jet member 22, which releases air just behind the spray opening 6 to atomize the sprayable material. The user removes the fingertip from the control orifice 2 or the floating control button 7 to release the air back into the atmosphere and to stop the spraying action.

While the descriptions above refer to particular embodiments of the present invention, it will be understood that many modifications may be made without departing from the spirit thereof. The accompanying claims are intended to cover such modifications as would fall within the true scope and spirit of the present invention. The presently disclosed embodiments are therefore to be considered in all respects as illustrative and not restrictive, the scope of the invention being indicated by the appended claims, rather than the foregoing description, and all changes that come within the meaning and range of equivalency of the claims are therefore intended to be embraced therein.

What is claimed is:

1. A refillable spray apparatus for atomizing a sprayable material, the apparatus comprising:

a container, with an open top and a closed bottom, defining a main chamber, the container being fillable with the sprayable material;

a cap defining a top chamber and having a front opening;

a button hole disposed on the cap;

a sealing disk disposed in the container adjacent to the open top thereof, the cap being retained in contact with a portion of the sealing disk, such that the cap and the container are selectively united;

an equalization port on the sealing disk;

an elbow having a spray opening and coupled to a dip tube attachment sleeve on the sealing disk and adapted to fit through the front opening of the cap;

a dip tube coupled to the dip tube attachment sleeve on the sealing disk extending into the main chamber;

an equalization tube having a control orifice, which can be selectively opened and closed thereby selectively pressurizing the main chamber of the container, the equalization tube coupled to the equalization port on the sealing disk;

an air jet member coupled to the equalization tube and the elbow, adjacent to and in flow alignment with the spray opening of the elbow, the air jet member for atomizing the sprayable material during spraying; and an air inlet port disposed on the container allowing air flow into the main chamber.

2. The refillable spray apparatus according to claim 1, further comprising:

a floating control button seated within the button hole on the cap so as to close the control orifice of the equalization tube when depressed.

3. The refillable spray apparatus according to claim 1, further comprising:

a gasket disposed on the sealing disk.

4. The refillable spray apparatus according to claim 1, further comprising:

an air passage tube coupled to the air inlet port and disposed inside the container allowing air flow into the main chamber.

5. The refillable spray apparatus according to claim 1, wherein the air inlet port is adapted to interconnect with a hose to an external air supply device.

6. The refillable spray apparatus according to claim 4, wherein a rubber flap cap is coupled to one end of the air passage tube allowing only one-way air flow into the main chamber and preventing the sprayable material from being poured down the air passage tube.

7. The refillable spray apparatus according to claim 1, further comprising:

a spray nozzle adapted to fit on the spray opening of the elbow.

8. The refillable spray apparatus according to claim 1, wherein an attachment member on the container is adapted to secure to a retaining member on the cap to retain the cap to the container.

9. The refillable spray apparatus according to claim 7, wherein the spray nozzle comprises:

an adjustable spray cap;

a rubber nozzle member having an adjustable spray orifice seated within the adjustable spray cap;

a small washer engaging the rubber nozzle member, further secured by a nozzle disk; and a large disk washer retaining the nozzle disk, the small washer, and the rubber nozzle member within the adjustable spray cap.

10. The refillable spray apparatus according to claim 7, wherein the spray nozzle comprises:

a plastic cap; and a metal disk having a spray orifice and secured within the plastic cap, whereby the metal disk allows the spraying of abrasive materials without damaging the spray nozzle.

11. A refillable spray apparatus for atomizing a sprayable material, the apparatus comprising:

a container, with an open top and a closed bottom, defining a main chamber, the container being fillable with the sprayable material;

a cap defining a top chamber and having a front opening;

a button hole disposed on the cap;

a sealing disk disposed in the container adjacent to the open top thereof, the cap being retained in contact with a portion of the sealing disk, such that the cap and the container are selectively united;

an equalization port on the sealing disk;

an elbow having a spray opening and coupled to a dip tube attachment sleeve on the sealing disk and adapted to fit through the front opening of the cap;

a dip tube coupled to the dip tube attachment sleeve on the sealing disk extending into the main chamber;

an equalization tube having a control orifice, which can be selectively opened and closed thereby selectively pressurizing the main chamber of the container, the equalization tube coupled to the equalization port on the sealing disk;

an air jet member coupled to the equalization tube and the elbow, adjacent to and in flow alignment with the spray opening of the elbow, the air jet member for atomizing the sprayable material during spraying;

an air inlet port disposed on the container allowing air flow into the main chamber, wherein the air inlet port is adapted to interconnect with a hose to an external air supply device;

a floating control button seated within the button hole on the cap so as to close the control orifice of the equalization tube when depressed;

a gasket disposed on the sealing disk;

an air passage tube coupled to the air inlet port and disposed inside the container allowing air flow into the main chamber;

a rubber flap cap coupled to one end of the air passage tube allowing only one-way air flow into the main chamber and preventing the sprayable material from being poured down the air passage tube;

a spray nozzle adapted to fit on the spray opening of the elbow; and an attachment member on the container adapted to secure to a retaining member on the cap to retain the cap to the container.

12. The refillable spray apparatus according to claim 11, wherein the spray nozzle comprises:

an adjustable spray cap;

a rubber nozzle member having an adjustable spray orifice seated within the adjustable spray cap;

a small washer engaging the rubber nozzle member, further secured by a nozzle disk; and a large disk washer retaining the nozzle disk, the small washer, and the rubber nozzle member within the adjustable spray cap.

13. The refillable spray apparatus according to claim 7, wherein the spray nozzle comprises:

a plastic cap; and a metal disk having a spray orifice and secured within the plastic cap, whereby the metal disk allows the spraying of abrasive materials without damaging the spray nozzle.

14. A refillable spray apparatus for atomizing a sprayable material, the apparatus comprising:

a container, with an open top and a closed bottom, defining a main chamber, the container being fillable with the sprayable material;

a cap defining a top chamber and having a front opening;

a button hole disposed on the cap;

a sealing disk disposed in the container adjacent to the open top thereof, the cap being retained in contact with a portion of the sealing disk, such that the cap and the container are selectively united;

an equalization port on the sealing disk;

a dip tube having a curved top with a spray opening and extending through a dip tube attachment sleeve on the sealing disk into the main chamber of the container;

an equalization tube having a control orifice, which can be selectively opened and closed thereby selectively pressurizing the main chamber of the container, the equalization tube coupled to the equalization port on the sealing disk;

an air jet member coupled to the equalization tube and the curved top of the dip tube, adjacent to and in flow alignment with the spray opening of the dip tube, the air jet member for atomizing the sprayable material during spraying; and an air inlet port disposed on the container allowing air flow into the main chamber.

15. The refillable spray apparatus according to claim 14, further comprising:

a floating control button seated within the button hole on the cap so as to close the control orifice of the equalization tube when depressed.

16. The refillable spray apparatus according to claim 14, further comprising:

a gasket disposed on the sealing disk.

17. The refillable spray apparatus according to claim 14, further comprising:

an air passage tube coupled to the air inlet port and disposed inside the container allowing air flow into the main chamber.

18. The refillable spray apparatus according to claim 14, wherein the air inlet port is adapted to interconnect with a hose to an external air supply device.

19. The refillable spray apparatus according to claim 17, wherein a rubber flap cap is coupled to one end of the air passage tube allowing only one-way air flow into the main chamber and preventing the sprayable material from being poured down the air passage tube.

20. The refillable spray apparatus according to claim 14, further comprising:

a spray nozzle adapted to fit on the spray opening of the dip tube.

21. The refillable spray apparatus according to claim 14, wherein an attachment member on the container is adapted to secure to a retaining member on the cap to retain the cap to the container.

22. The refillable spray apparatus according to claim 14, wherein the spray nozzle comprises:

an adjustable spray cap;

a rubber nozzle member having an adjustable spray orifice seated within the adjustable spray cap;

a small washer engaging the rubber nozzle member, further secured by a nozzle disk; and a large disk washer retaining the nozzle disk, the small washer, and the rubber nozzle member within the adjustable spray cap.

23. The refillable spray apparatus according to claim 14, wherein the spray nozzle comprises:

a plastic cap; and a metal disk having a spray orifice and secured within the plastic cap, whereby the metal disk allows the spraying of abrasive materials without damaging the spray nozzle.

* * * * *